US011661718B2

(12) United States Patent
Henderson

(10) Patent No.: US 11,661,718 B2
(45) Date of Patent: May 30, 2023

(54) CONCRETE PIER FOUNDATION WITH LATERAL SHEAR REINFORCING LOOPS AND METHODS OF CONSTRUCTING THE SAME

(71) Applicant: Terracon Consultants, Inc., Olathe, KS (US)

(72) Inventor: Allan P. Henderson, Bakersfield, CA (US)

(73) Assignee: TERRACON CONSULTANTS, INC., Olathe, KS (US)

( * ) Notice: Subject to any disclaimer, the term of this patent is extended or adjusted under 35 U.S.C. 154(b) by 233 days.

(21) Appl. No.: 16/518,143

(22) Filed: Jul. 22, 2019

(65) Prior Publication Data

US 2020/0032476 A1 Jan. 30, 2020

Related U.S. Application Data

(60) Provisional application No. 62/703,217, filed on Jul. 25, 2018.

(51) Int. Cl.
*E02D 27/42* (2006.01)
*E02D 5/38* (2006.01)

(52) U.S. Cl.
CPC ..... *E02D 27/42* (2013.01); *E02D 5/38* (2013.01); *E02D 2200/12* (2013.01); *E02D 2300/002* (2013.01)

(58) Field of Classification Search
None
See application file for complete search history.

(56) References Cited

U.S. PATENT DOCUMENTS

| | | | | |
|---|---|---|---|---|
| 732,485 | A | 6/1903 | Wight | |
| 969,039 | A | 8/1910 | Cowles | |
| 1,139,384 | A | 5/1915 | Taf | |
| 1,189,459 | A * | 7/1916 | Lundin | H02G 7/20 174/45 R |
| 1,529,895 | A | 3/1925 | Chance et al. | |
| 1,647,925 | A | 11/1927 | May | |
| 2,377,055 | A | 5/1945 | Thornley | |
| 2,625,815 | A | 1/1953 | Black | |

(Continued)

FOREIGN PATENT DOCUMENTS

| | | |
|---|---|---|
| CA | 2551712 | 6/2012 |
| DE | 2754577 | 6/1979 |

(Continued)

OTHER PUBLICATIONS

Declaration of Dr. John T. Bryant in Support of Petition for Inter Partes U.S. Pat. No. 7,618,217 (filed Sep. 9, 2021).

(Continued)

*Primary Examiner* — Joshua K Ihezie
(74) *Attorney, Agent, or Firm* — Jacobson Holman PLLC

(57) ABSTRACT

A concrete pier foundation having a plurality of sleeved tower anchor bolts embedded therein and a spiral loop encasement providing lateral shear reinforcement is provided. The spiral loop encasement surrounds at least a lower portion of the concrete pier and is formed by hoop steel wrapped around the perimeter of the tower anchor bolt cage. In proper soils or rock the spiral loop encasement can eliminate the need for corrugated metal pipes, reducing the cost and complexity of construction.

1 Claim, 6 Drawing Sheets

(56) References Cited

U.S. PATENT DOCUMENTS

| | | | | |
|---|---|---|---|---|
| 2,971,295 | A | 2/1961 | Reynolds | |
| 3,646,748 | A | 3/1972 | Lang | |
| RE27,732 | E | 8/1973 | Van Buren | |
| 3,798,868 | A | 3/1974 | Loranger | |
| 3,927,497 | A | 12/1975 | Yoshinaga et al. | |
| 4,043,133 | A | 8/1977 | Yegge | |
| 4,051,661 | A | 10/1977 | Leprohon, Jr. et al. | |
| 4,068,445 | A | 1/1978 | Bobbitt | |
| 4,092,811 | A | 6/1978 | Lin et al. | |
| 4,197,695 | A | 4/1980 | Hughes et al. | |
| 4,247,225 | A | 1/1981 | Chickini, Jr. et al. | |
| 4,866,903 | A | 9/1989 | Ferstay | |
| 4,887,691 | A | 12/1989 | Rotondo | |
| 5,218,805 | A | 6/1993 | Rex | |
| 5,505,033 | A | 4/1996 | Matsuo et al. | |
| 5,586,417 | A * | 12/1996 | Henderson | E02D 27/42 405/233 |
| 5,623,792 | A | 4/1997 | Crumpacker | |
| 5,826,387 | A | 10/1998 | Henderson et al. | |
| 5,966,882 | A | 10/1999 | Naito | |
| 6,102,118 | A | 8/2000 | Moore | |
| 6,659,691 | B1 | 12/2003 | Berry | |
| 6,665,990 | B1 | 12/2003 | Cody et al. | |
| 6,672,023 | B2 * | 1/2004 | Henderson | F03D 13/22 52/296 |
| 6,705,058 | B1 * | 3/2004 | Foust | E04C 3/32 52/296 |
| 6,782,667 | B2 | 8/2004 | Henderson | |
| 7,155,875 | B2 | 1/2007 | Henderson | |
| 7,533,505 | B2 * | 5/2009 | Henderson | E04H 12/085 52/292 |
| 7,618,217 | B2 | 11/2009 | Henderson | |
| 7,707,797 | B2 | 5/2010 | Henderson | |
| 7,905,069 | B1 | 3/2011 | Lockwood | |
| 8,720,139 | B2 | 5/2014 | Henderson | |
| 9,096,986 | B2 | 8/2015 | Henderson | |
| 9,340,947 | B2 | 5/2016 | Henderson | |
| 9,481,973 | B2 | 11/2016 | Henderson | |
| 9,783,950 | B2 * | 10/2017 | Henderson | E02D 37/00 |
| 10,640,995 | B2 * | 5/2020 | Phuly | E02B 17/027 |
| 2002/0050110 | A1 | 5/2002 | Ytterberg | |
| 2002/0095878 | A1 | 7/2002 | Henderson | |
| 2002/0124502 | A1 * | 9/2002 | Henderson | E04H 12/085 52/296 |
| 2004/0261340 | A1 | 12/2004 | Behlinger et al. | |
| 2005/0005562 | A1 | 1/2005 | Henderson et al. | |
| 2011/0173897 | A1 | 7/2011 | Schneider | |
| 2012/0047830 | A1 | 3/2012 | Phuly | |
| 2012/0070233 | A1 | 3/2012 | Wang et al. | |
| 2012/0151860 | A1 | 6/2012 | Li | |
| 2012/0266447 | A1 * | 10/2012 | Diaz-Vallellanes | H02G 9/06 29/525.11 |
| 2012/0314540 | A1 | 12/2012 | Alter | |
| 2013/0129474 | A1 | 5/2013 | Schacknies et al. | |
| 2013/0255169 | A1 | 10/2013 | Henderson | |
| 2014/0260023 | A1 * | 9/2014 | Henderson | E02D 27/50 52/295 |
| 2014/0260223 | A1 | 9/2014 | Long et al. | |
| 2015/0376859 | A1 * | 12/2015 | Phuly | E02D 27/425 52/223.1 |
| 2018/0264680 | A1 * | 9/2018 | Phuly | E04G 21/02 |
| 2020/0032476 | A1 * | 1/2020 | Henderson | E02D 27/42 |
| 2020/0032478 | A1 | 1/2020 | Rajewski | |

FOREIGN PATENT DOCUMENTS

| | | |
|---|---|---|
| DE | 10105472 | 8/2002 |
| DE | 202012006606 | 11/2012 |
| EP | 0160135 | 11/1985 |
| EP | 1526278 | 4/2005 |
| FR | 2833029 | 6/2003 |
| JP | 60-92518 | 5/1985 |
| JP | 61-109826 | 5/1986 |
| JP | 64-71987 | 3/1989 |
| JP | 4-353117 | 12/1992 |
| JP | 5-311678 | 11/1993 |
| JP | H5-311678 | 11/1993 |
| JP | 8-338034 | 12/1996 |
| JP | 9-256390 | 9/1997 |
| JP | 11-181797 | 7/1999 |
| JP | 2001-200582 | 7/2001 |
| JP | 2002-061201 | 2/2002 |
| JP | 2003-013442 | 1/2003 |
| JP | 2003-232046 | 8/2003 |
| JP | 2005-220554 | 8/2005 |
| JP | 2010-65454 | 3/2010 |
| KR | 2001/0057453 | 7/2001 |
| WO | WO 84/03531 | 9/1984 |
| WO | WO 02/27105 | 4/2002 |
| WO | WO 02/099204 | 12/2002 |
| WO | WO 2011/029994 | 3/2011 |
| WO | WO 2012/037450 | 3/2012 |
| WO | WO 2012/062425 | 5/2012 |

OTHER PUBLICATIONS

Declaration of Dr. John T. Bryant in Support of Petition for Inter Partes U.S. Pat. No. 7,533,505 (filed Sep. 9, 2021).
Declaration of Dr. John T. Bryant in Support of Petition for Inter Partes U.S. Pat. No. 7,707,797 (filed Sep. 9, 2021).
Newman, Morton. Structural Details for Concrete Construction. McGraw Hill Book Company, 1998.
Peck et al. Foundation Engineering, Second Edition, John Wiley & Sons, 1953.
Federal Highway Administration Transportation. Geotechnical Engineering Circular N. 4, Ground Anchors and Anchored Systems, Jun. 1999.
Petition for Inter Partes Review of U.S. Pat. No. 7,533,505 filed Sep. 10, 2021.
Petition for Inter Partes Review of U.S. Pat. No. 7,618,217 filed Sep. 10, 2021.
Petition for Inter Partes Review of U.S. Pat. No. 7,707,797 filed Sep. 10, 2021.
Post-Tensioning Manueal, Fifth Edition, Post-Tensioning Institute, 1990.
Prestressed Concrete, PCA America's Cement Manufacturers, 1916.
Kelley. A. Short History of Unbounded Post-Tensioning Specifications, Concrete Repair Bullentine, Jul./Aug. 2001.
Design Examples; Attachment 8.
Nigels, McLeod C. Prestressed Conrete Tension Piles and Their Connections, PCI Journal, Jul.-Aug. 1988.
Reflections on the Beginnings of Prestressed Concrete in America, The Prestressed Concrete Institute, 1981.
U.S. Department of Transportation Federal Highway Administration. Post-Tensioning Tendon Installation and Grouting Manuarl, Version 2.0, May 2013.
Aschenbroich, Horst. Dipl. Ing. A Post Tensioned Micropile Foundation System with Groutable Void Forms (GVF).
Aschenbroich, Horst, Dipl. Ing. Micro Pile Reinforcement Systems and Corrosion Protection, 2001.
Deformation of Reinforced Concrete Anchor Foundations in the Far Norht, Plenum Publishing Corporation, 1991.
Crabtree et al. The Strengthening of Transmission Tower Foundations Using Grouted Anchor Bars.
Kim, Nak-Kyung. Performance of Tension and Compression Anchors in Weathered Soil. Journal of Geotechnical and Geoenvironmental Engineering, Dec. 2003.
Dams—Innovations for Sustainable Water Resources, 22$^{nd}$ Annual USSD Conference San Diego, California, Jun. 24-28, 2002.
Prestressed Concrete Bridges.
Wind Turbine Anchoring Solutions, Peikko Group, Concrete Connections.
Standard Specification for Steel Strand, Uncoated Seven-Wire for Prestressed Concrete, ASTM International.
Allam et al. Crack width evaluation for flexural RC members. Alexandria Engineering Journal, (2012) 51, 211-220.
Svensson, Henrick. Design of Foundations for Wind Turbines, 2010.

(56) References Cited

OTHER PUBLICATIONS

Eurooppalainetekninen hyväksyntä. ETA-10/02; European Technical Approval. VTT Expert Services Oy. Issued Apr. 21, 2011.
Bruce et al. Foundation Rehabilitation of the Pocomoke River Bridge, Maryland, Using High Capacity Preloaded Pinpiles, The Conference on Bridges official proceedings. Jun. 4-6, 1984.
Peikko's Foundation Solution Chosen for Wing for Wing Park to be Built in Hamina, Finland. https://web.archive.org/web/20111228043258/http://www.peikko.com/news/n=Peikko%27s+Foundation+Solution+choses+for+Wind+Park+to+be+builtin+in+Hamina%2c+Finland.
Hevosselka Wind Park, Tervola, Finland, https://www.peikko.com/reference/hevosselka-wind-park.
Loflin, Bryan J. Bond and Material Properties of Grade 270 and Grade 300 Prestressing Strands. Jun. 10, 2008.
Peikko to supply the wind turbine tower foundation solution to Finnish Muukko wing park. https://web.archive/org/web/20121001214327/http://www.peikko.com/news/n=Peikko+to+supply+the+wing+turbine+tower+foundation+solution+to+Finnish+Muukko+wing+park.
Muukko Wind Park, Lappeenranta, Finland, https://www.peikko.com/reference/miiukko-wind-park/.
Mäkelänkangas Wind Park, Hamina, Finland. https://www.peikko.com/reference/makelankangas-wind-park/.
https://web.archive.org/web/20121003065612/http://www.peikko.com:80/news/year=2012.
Peikko and Enercon to Expand Their Cooperation. Press Release Apr. 5, 2011. https://web.archive/org/web/20110814012119/http://www.peikko.com/news/n=Peikko+and+Enecon+to+expand+their+cooperation.
Peikko to supply the wind turbine tower foundation solution to Finnish Muukko wind park. https://www.peikko.cz/novinky/peikko-to-supply-the-wind-turbine-tower-foundation-solution-to-finnish-muukko-wind-park-w/.
Peikko Group: Product Catalogue. Jul. 2, 2012.
Aschenbroich, Horst Dipl.lng. Reinforcement of dams in Canada and the USA. Www.contechsvstems.com.
https://web.arcive.org/web/20121003064830/http://www.peikko.com/news/year=2012/month=05.
Wind Turbines Uljabuouda, Sweden, Project Story in PeikkoNews Feb. 2009. https://web.archive.org/web/20120320121335/http:www.peikko.com/reference-main/references/rg=Power+Plants+and+Lines/r=Wind+Turbines+Ulkabuouda+%2C+Sweden.
A unique turnkey solution for wind turbine tower foundations. https://web.archive.org/ . . . b/20120403071116/http://www.peikko.com/solutions-category/solutions/s=A+unique+turnkey+solution+for+wind+turbine+tower+foundations/SID=24072976.
Clemence, Samuel P., Uplift Behavior of Anchor Foundations in Soil. Proceedings of a session sponsored by the Geotechnical Engineering Division of the American Society of Civil Engineers in conjunction with the ASCE Convention in Detroit, Michigan. Oct. 24, 1985.
Benefits for wind energy specialist. https://web.archive/org/web/20121030175316/http://www.peikko.com/group/t=Wind+Energy+Specialist.
Affidavit of Josef Alter in U.S. Appl. No. 11/428,778, executed on Jun. 2, 2009.

* cited by examiner

CONCRETE PIER FOUNDATION WITH LATERAL SHEAR REINFORCING LOOPS AND METHODS OF CONSTRUCTING THE SAME

This application claims priority from U.S. provisional application Ser. No. 62/703,217, filed Jul. 25, 2018.

BACKGROUND OF THE INVENTION

Field of the Invention

The present invention relates to concrete foundations used to support tall, heavy and/or large towers and the like, and to methods for the construction thereof.

Description of the Related Art

Concrete foundation structures of various kinds have been developed to support commercial signs, traffic signs, light poles and the like. To support larger structures including tall and heavy towers and wind turbines that exert significant overturning force on the foundation. Applicant developed and commercialized a tensionless pier foundation which is described in U.S. Pat. No. 5,586,417 ("the '417 patent"). The '417 patent is hereby expressly incorporated by reference as if fully set forth in its entirety herein.

The tensionless pier foundation described in the '417 patent includes a concrete foundation formed as a cylinder having an outer boundary shell defined by a corrugated metal pipe (CMP) and an inner boundary formed by a second CMP of smaller diameter. Elongated high strength steel bolts run from an anchor flange near the bottom of the concrete cylinder vertically up through the concrete to extend above the upper end of the foundation and through a connecting flange for the supported structure to be connected on top of the foundation. The bolts are encased in sleeves or hollow tubes over a substantial portion of their vertical extent in the concrete to allow the encased portion of the bolts to be stretched and thus tensioned. With such tensioning of the bolts, the concrete is kept under constant compression while the bolts are always in static tension. Thus, the pier foundation in the '417 patent is referred to as "tensionless" due to the absence of tensile stress on the concrete.

The '417 patent construction was a significant improvement over previously known concrete foundations that incorporated a reinforcing steel bar matrix and were subject to repeatedly alternating tensile and compressive loads on the concrete, leading to fatigue and, in many cases, premature failure. Additional improvements in tensionless concrete foundations are shown in Applicant's other U.S. Pat. Nos. 8,720,139 ("the '139 patent") and 9,340,947 ("the '947 patent"), among others. The complete disclosures of the '139 and '947 patents are hereby expressly incorporated by reference as if fully set forth in their entirety herein.

In addition to tension and compression loads, concrete foundations are also subject to shear stress. Therefore, it would be beneficial to have a tensionless pier foundation that is more resistant to shear stress and that can be constructed in various configurations to reduce the overall cost of the foundation, particularly when constructing in rock or stable soils.

SUMMARY OF THE INVENTION

In view of the foregoing, the present invention is directed to a pier foundation having a plurality of elongated tower anchor bolts embedded within sleeves in a concrete pier and secured at their lower ends to an anchor or embedment ring to form a tower anchor bolt cage. The upper ends of the anchor bolts extend above the top of the concrete so that the bolts, which bear the tensile load, can be post-tensioned to keep the concrete pier under compression in like manner to the construction described in the '417 patent. To increase the lateral shear stress resistance of the foundation, at least a lower portion, and preferably at least the bottom third, of the concrete pier is surrounded by a spiral hoop encasement formed by hoop steel around the perimeter of the tower anchor bolt cage.

The present invention is also directed to a pier foundation in which the spiral hoop encasement encircles nearly the entire vertical extent of the pier foundation. When constructed in rock or stable soils that, when drilled or excavated, leave side walls that stand vertically, the full vertical extent spiral hoop encasement eliminates the need for an outer CMP and, depending upon the formation of the center of the pier, can also eliminate the need for an inner CMP as well.

Addition, the present invention is directed to various methods of constructing a pier foundation having a spiral hoop encasement at reduced cost, particularly in rock or stable soils.

Accordingly, it is an object of the present invention to provide a concrete pier foundation that is highly resistant to both upset and lateral shear stress.

Another object of the present invention is to provide a concrete pier foundation in accordance with the preceding object that is maintained under compression in excess of expected tension forces when resisting upset of a supported tower while at least, the bottom portion of the foundation is surrounded by a spiral hoop encasement for increased lateral shear resistance.

A further object of the present invention is to provide a concrete pier foundation in accordance with the preceding objects in which the spiral hoop encasement is formed by hoop steel around the perimeter of the tower anchor bolt cage.

Yet another object of the present invention is to provide a concrete pier foundation in accordance with the preceding objects in which the spiral hoop encasement extends nearly the full vertical extent of the foundation from the anchor ring at the base to or near the top of the concrete.

Still another object of the present invention is to provide a concrete pier foundation in accordance with the preceding object in which the foundation is constructed without an outer CMP.

A further object of the present invention is to provide a concrete pier foundation in accordance with the preceding two objects in which the foundation is constructed in rock or stable soil without either an outer CMP or an inner CMP.

A still further object of the present invention is to provide a concrete pier foundation in accordance with the preceding object in which the foundation is formed within a dug-out annular trench with native soil remaining undisturbed inside the area surrounded by the trench.

Yet a further object of the present invention is to provide a concrete pier foundation in accordance with the object before the preceding object in which the foundation is formed by excavating a cylindrical hole and filling the entire hole, including the center area encircled by the bolt cage, with concrete.

Another object of the present invention is to provide one or more methods of installing a concrete pier foundation having a tower anchor bolt cage at least partially wrapped with a spiral hoop encasement for lateral shear reinforcement in which the foundation is constructed without an outer CMP, or without either an outer CMP or an inner CMP.

Yet another object of the present invention is to provide a method of constructing a concrete pier foundation without any CMPs in accordance with the preceding object that includes digging an annular trench with native soil remaining undisturbed inside the area surrounded by the trench and filling the trench with concrete after the tower anchor bolt cage wrapped with the spiral hoop encasement is positioned therein.

Still another object of the present invention is to provide a method of constructing a concrete pier foundation without any CMPs in accordance with the object before the preceding object that includes digging a cylindrical hole and filling the hole with concrete after the tower anchor bolt cage wrapped with the spiral hoop encasement is positioned therein.

A further object of the present invention is to provide a method of constructing a laterally reinforced concrete pier foundation that includes excavating a hole, assembling a tower anchor bolt cage including a plurality of sleeved anchor bolts in an annular arrangement and secured at their lower ends to an anchor ring, wrapping an outer perimeter of the tower anchor bolt cage with a spiral loop steel addition over at least a lower end thereof to provide lateral shear reinforcement to the pier foundation, and securing the wrapped tower anchor bolt cage with concrete after the cage is positioned within the hole with the anchor ring at the bottom of the pier.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
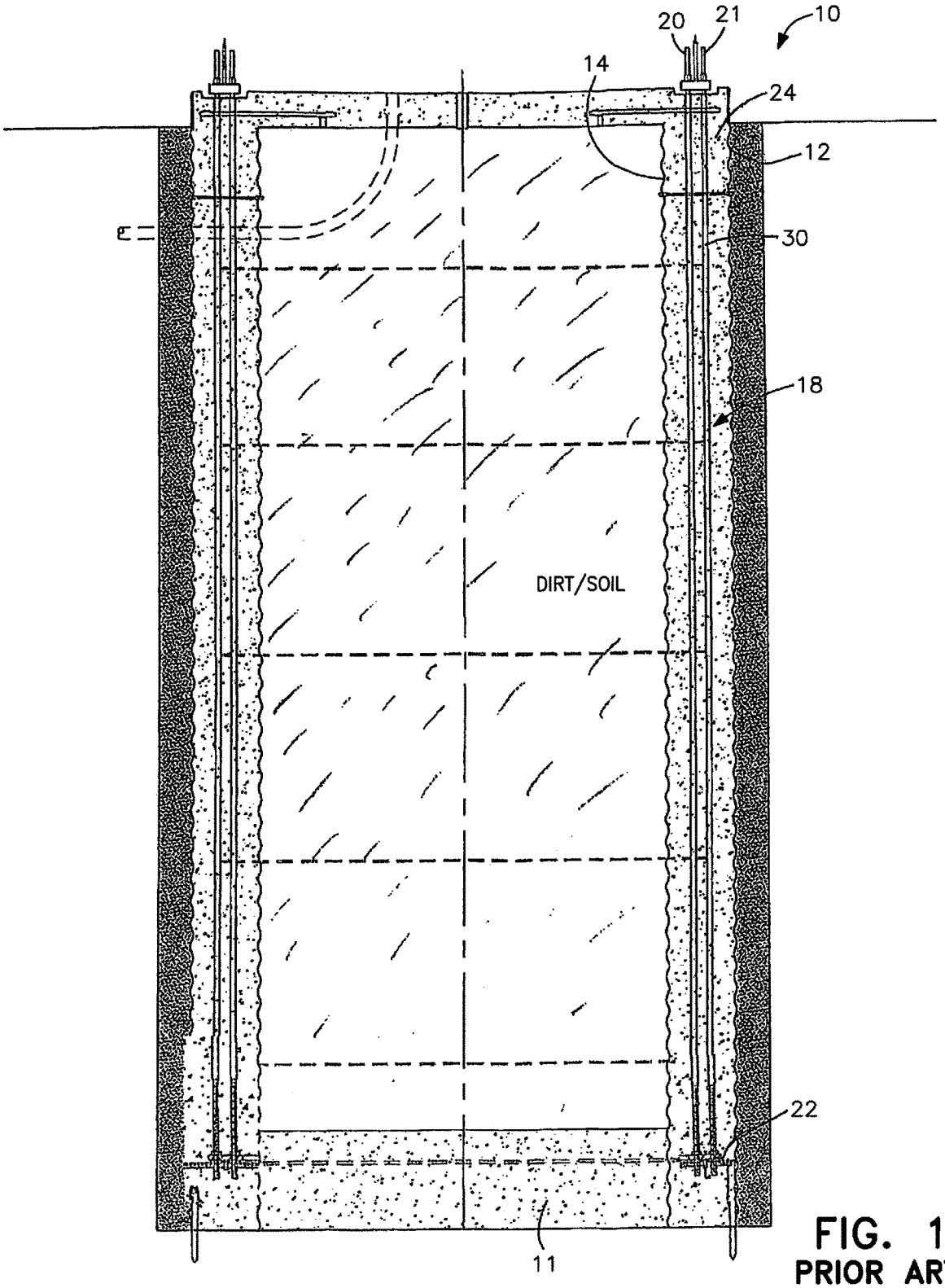
FIG. 1 PRIOR ART
FIG. 1 shows a concrete pier foundation like that disclosed in the '417 patent.

It is to be understood that the embodiments described herein are disclosed by way of illustration only. It is not intended that the invention be limited in its scope to the details of construction and arrangement of components set forth in the following description or illustrated in the drawings. Also, in describing the preferred embodiments, specific terminology will be resorted to for the sake of clarity. It is to be understood that each specific term includes all technical equivalents which operate in a similar manner to accomplish a similar purpose.

Figure 1A:
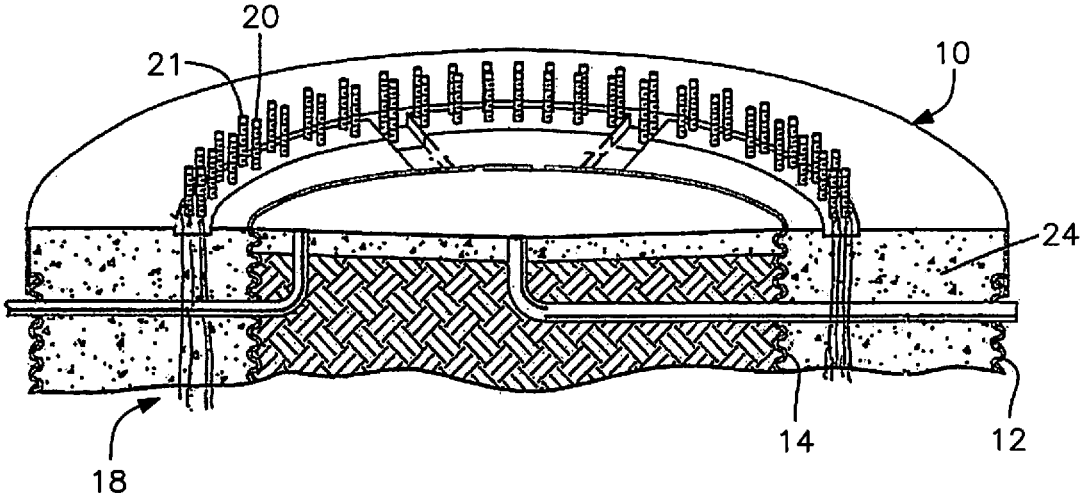
FIG. 1A PRIOR ART
FIG. 1A is a cross-sectional view of the upper end of the pier foundation shown in FIG. 1.

A concrete pier foundation like that disclosed in the '417 patent is shown in FIG. 1. The concrete pier foundation, generally designated by reference numeral 10, includes an outer corrugated metal pipe (CMP) 12, an inner CMP 14 and a plurality of tower anchor bolts 20, 21 fitted within sleeves 30 and secured at their lower ends to an anchor ring 22 to form a tower anchor bolt cage generally designated by reference numeral 13. The tower bolt cage 18 is arranged in the annular area 24 formed between the outer and inner CMPs 12, 14, as shown in FIG. 1A, with the anchor ring 22 at the bottom of the excavation. The outer diameter of the tower anchor bolt cage 18 is generally on the order of about 14 feet. After the concrete is poured between the CMPs, the upper ends of the tower anchor bolts 20, 21 extend upwardly to project above the top of the concrete for post-tensioning thereof. As shown in FIG. 1, the lowermost ends of the bolts adjacent and above the anchor ring 22 are not covered by the sleeves 30 to facilitate frictional engagement with the concrete. The sleeves may be hollow tubes or a sleeved effect may be obtained by wrapping the bolts in plastic tape, coating the bolts with a suitable lubrication, or the like. Reference is made to the '417 and '947 patents for a more detailed description of the structure and construction of the basic pier foundation 10 shown in FIG. 1.

Figure 2:
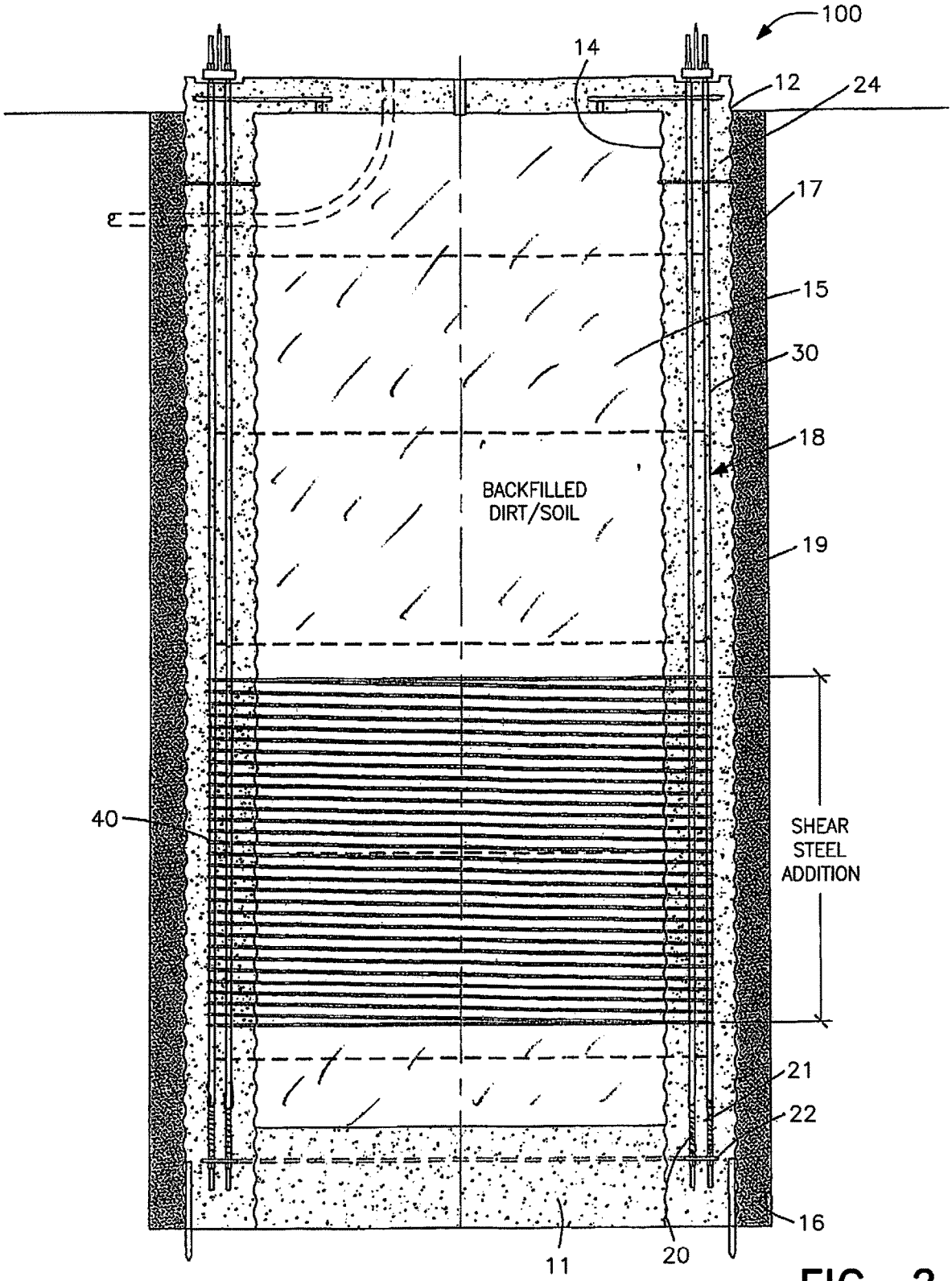
FIG. 2 is a pier foundation with a lateral shear steel addition or spiral hoop encasement surrounding a lower portion of the pier in accordance with a first embodiment of the present invention.

According to a first embodiment shown in FIG. 2, the present invention is directed to a pier foundation generally designated by reference numeral 100. As variously described in the '417 and '947 patents, the outer CMP 12 is initially placed within a hole or excavation formed in the ground and generally designated by reference numeral 16. The bolt cage 18 is installed vertically inside the outer CMP 12 with the anchor ring 22 at the bottom. The tower anchor bolts are nutted both atop and below the anchor ring to secure the anchor ring in place near the bottom of the foundation. The inner CMP 14 is then placed and positioned within the excavation 16 and the interior area 15 surrounded by the inner CMP 14 is partially backfilled along with the annular area 17 between the outer CMP 12 and the sidewall 19 of the excavation 16 to stabilize the CMPs generally in place within the excavation and relative to each other. Alternatively, a concrete plug 11 may be poured in the bottom of the inner CMP before backfilling as described in the '947 patent.

According to the present invention, while installing the tower anchor bolt cage 18 inside the outer CMP 12, a shear steel addition 40 is wrapped around the perimeter of the tower anchor bolt cage 18, preferably about the lower one third of the pier foundation, to provide the pier foundation 100 with improved lateral shear resistance. According to a preferred embodiment, the assembled cage 18 is wrapped while being lowered, such as by a crane or the like, into the excavation 16. The inner CMP 14 is then placed within the excavation, inwardly of the outer CMP and bolt cage, and a concrete plug 11 is poured in the interior area 15 at the bottom of the inner CMP to solidify its position. Cementitious material is then poured into the annular area 24 formed between the outer and inner CMPs and backfilling of the interior area 15 and annular area 17 with soil is completed.

The shear steel addition 40 may be made of hoop steel arranged in a plurality of loops vertically spaced between about three inches and about six inches apart, and preferably about four inches apart. When spaced about four inches apart, there are three loops per foot in the vertical dimension. This creates an angle from horizontal having a slope of about four inches over 14 feet.

The hoop steel is preferably one continuous strand although separate individual loops could be used with the understanding that installation would in most cases be more time consuming. The hoop steel strand is preferably either 0.5 inches or 0.6 inches in diameter and is high strength steel having a tensile strength on the order of 270,000 psi.

In vertical distance, the shear steel addition 40 as shown in FIG. 2 covers a minimum of 10 feet around the bottom of the foundation. However, the lateral reinforcement provided by the hoop steel may extend upwardly more than the bottom one-third of the anchor bolt cage and even to the full vertical extent of the pier foundation to form a spiral hoop encasement 140 as will be discussed in connection with the embodiments shown in FIGS. 3-5. With a full vertical extent, the spiral hoop encasement 140 would cover a foundation of approximately 34 feet which is the current maximum vertical height of existing foundations of this type being constructed in the field.

Figure 3:
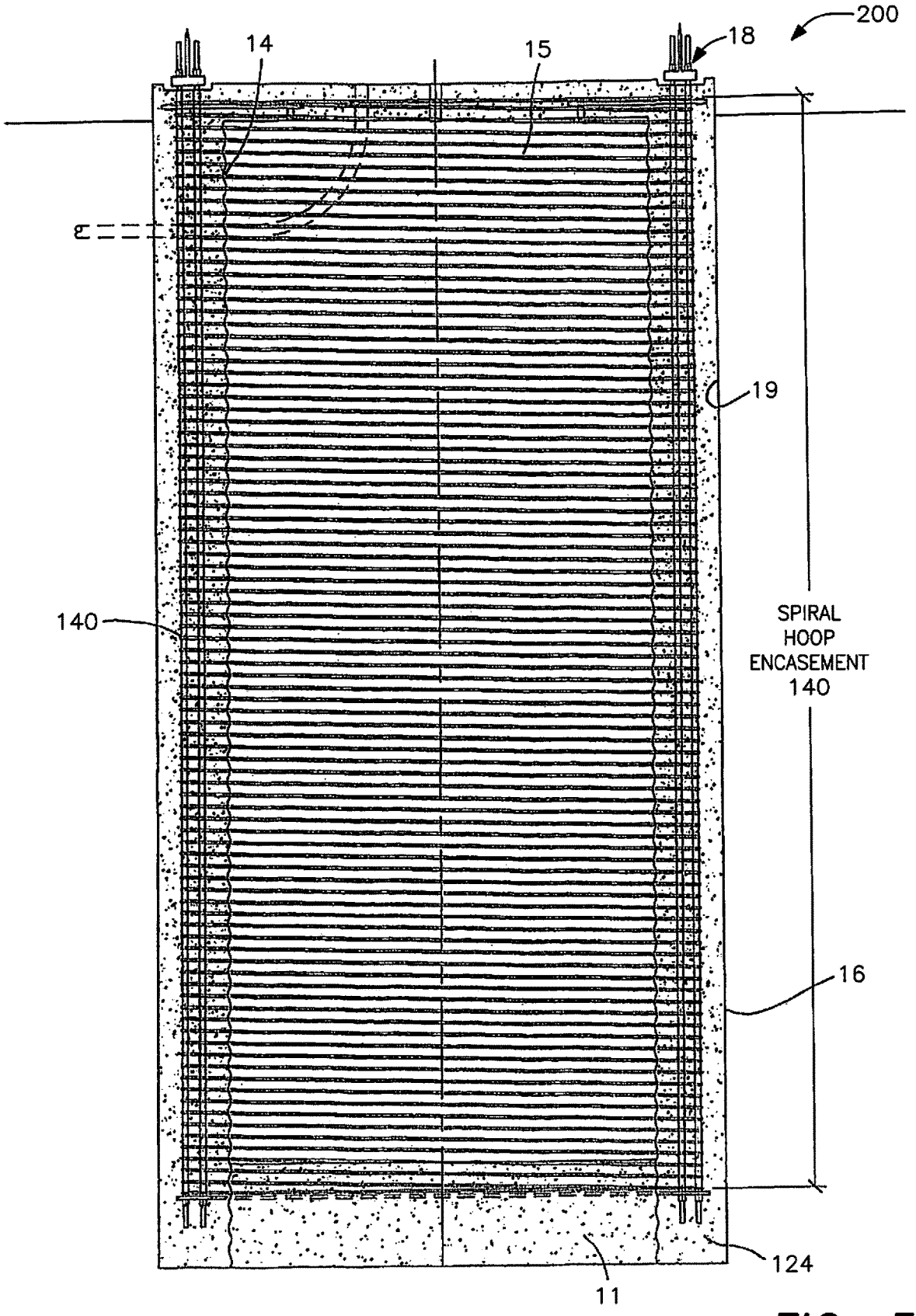
FIG. 3 is a concrete pier foundation constructed without an outer CMP and having a spiral hoop encasement that extends over the vertical extent of the pier in accordance with a second embodiment of the present invention.

The second embodiment of the present invention shown in FIG. 3 includes a pier foundation generally designated by reference numeral 200 having a spiral hoop encasement 140 that covers substantially the entire vertical extent of the pier foundation 200. As used herein, "substantially" is intended to cover spiral hoop encasements that cover at least 90% of the vertical extent, and preferably at least 95% of the vertical extent. The spiral hoop encasement 140 provides structural strength to the perimeter of the bolt cage 18 and eliminates the need for an outer CMP provided the surrounding sidewalls 19 of the excavation 16 are able to stand vertically when the hole for the foundation is drilled or excavated, such as in rock or stable soils.

The foundation 200 is constructed by drilling or excavating the hole 16, placing an inner CMP 14 and partly backfilling the center area 15 as necessary to stabilize the CMP 14. Alternatively, a concrete plug 11 may be poured to secure the inner CMP at the bottom. The tower bolt cage 18 is assembled outside the hole 16 and then wrapped with a spiral hoop encasement 140 while being lowered into the annular area 124 between the sidewalls 19 and the inner CMP 14. Concrete is then poured into the annular area 124 and any remaining backfilling of the center area of the inner CMP 14 completed. Alternatively, the tower bolt cage may be lowered into the excavation 16 before the inner CMP 14 is placed and the plug poured, as with the first embodiment. In either case, i.e., regardless of the installation order of the inner CMP and the tower bolt cage, the second embodiment eliminates the need for the outer CMP 12, reducing the cost of construction and also obviating the associated need to backfill with soil against the sidewall 19.

Figure 4:
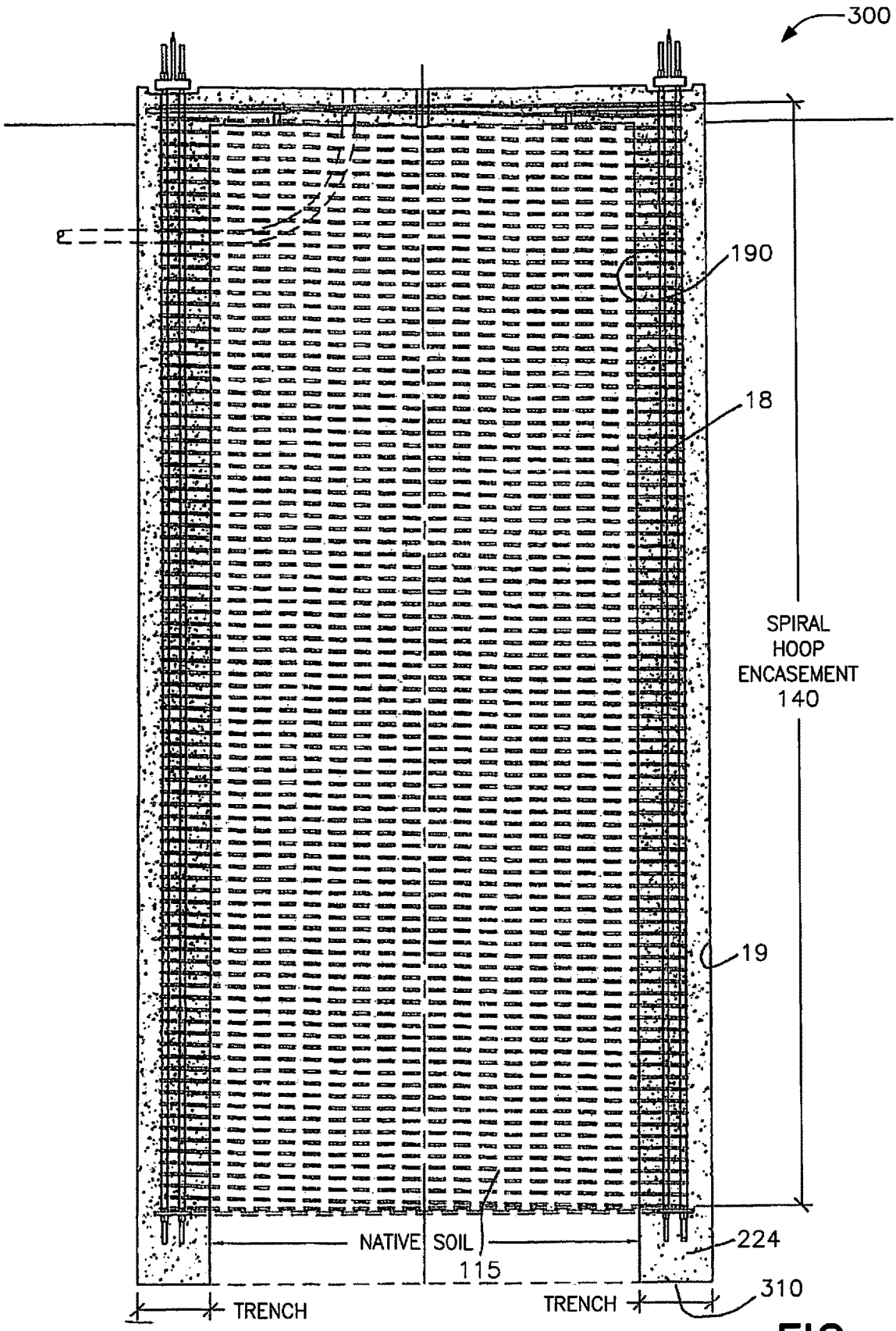
FIG. 4 is a concrete pier foundation with a spiral hoop encasement and no outer CMP like that shown in FIG. 3 but constructed in accordance with a third embodiment of the present invention, with the hole being excavated as an annular trench that surrounds a central area of undisturbed native soil, eliminating the need for an inner CMP.

A third embodiment of the pier foundation with lateral shear reinforcing loops of the present invention is shown in FIG. 4 and generally designated by reference numeral 300. The foundation 300 is suitable for installation in areas having rock or stable soil where the side walls 19 of drilled or excavated deep holes stand vertically. With such conditions, the excavation is formed as an annular trench 310 which is bordered by sidewall 19 and an inner sidewall 190. The inner sidewall 190 defines the outer perimeter of a central area 115 which is constituted by the native soil which is not disturbed. With such a configuration, both the outer and inner CMPs are eliminated along with the need to backfill the inner CMP. In addition, the trench construction of FIG. 4 also eliminates the need to form a concrete plug at the base of the pier to secure the inner CMP.

The foundation 300 is constructed by excavating the trench 310, assembling the tower bolt cage 18 and wrapping the same with a spiral hoop encasement 140 while lowering the tower bolt cage 18 into the annular area 124 between the sidewall 19 and the inner sidewall 190. Concrete is then poured into the trench 310. By eliminating the need for both CMPs as well as the plug, and by saving the man and equipment hours otherwise needed for backfilling, the trench configuration shown in FIG. 4 offers significant cost and time savings in construction.

Figure 5:
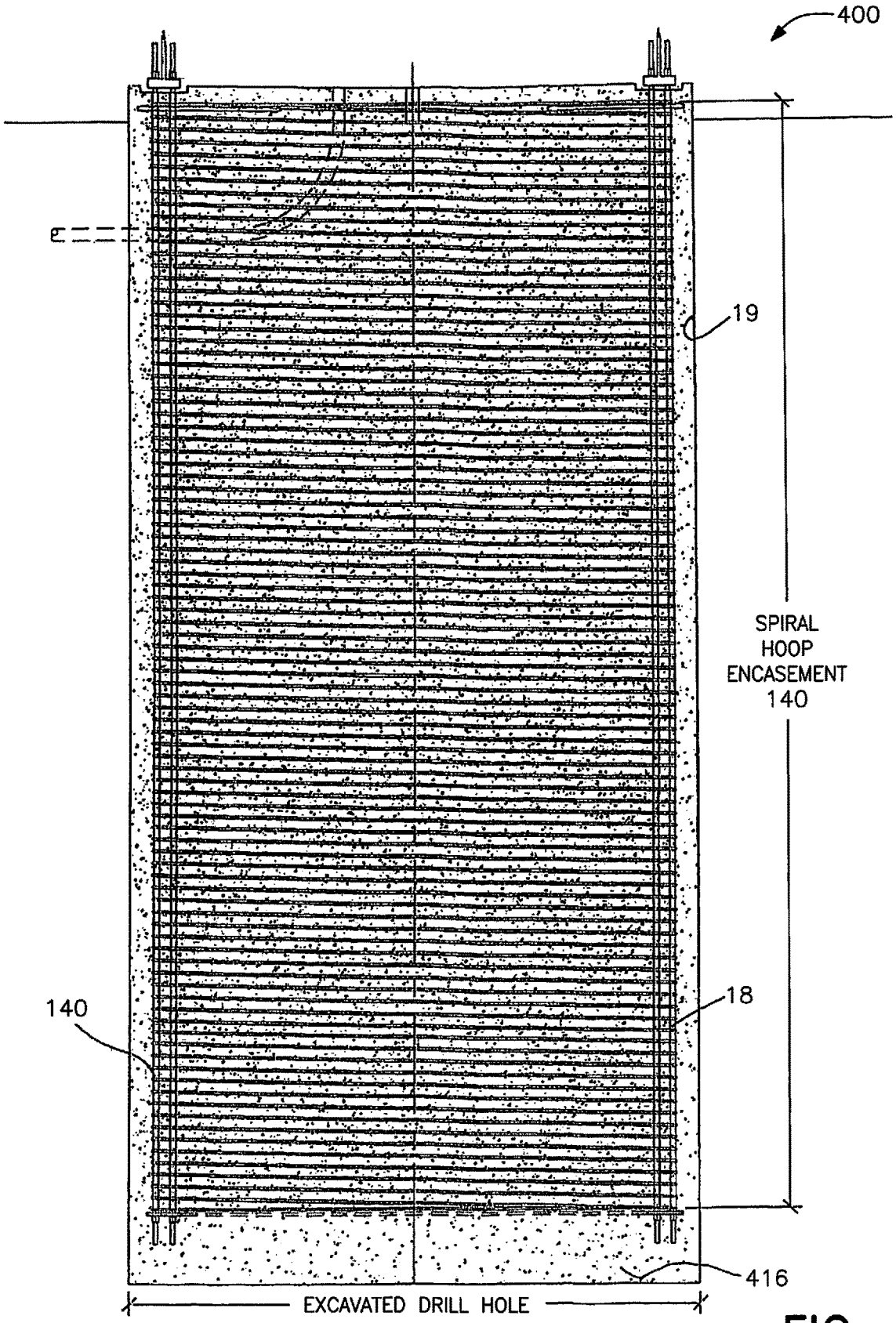
FIG. 5 is a concrete pier foundation with a spiral hoop encasement according to a fourth embodiment of the present invention in which, being constructed without CMPs, a cylindrical hole is excavated and then filled with concrete.

A fourth embodiment of the pier foundation with lateral shear reinforcing loops according to the present; invention is shown in FIG. 5 and generally designated by reference numeral 400. Like the previous two embodiments, the foundation 400 is suitable for use in stable soils and rock where the sidewalls 19 stand vertical upon excavation. A cylindrical drill, hole 416 is excavated, a tower bolt cage 18 wrapped with a spiral hoop encasement 140 is positioned therein, and the entire hole 416 is filled with concrete.

The spiral hoop encasement 140 of each of FIGS. 3-5 is made of one or more looped strands of high strength steel having the same structural parameters already discussed in connection with the shear steel addition 40 shown and described in connection with FIG. 2, The steel strands may be wound around the tower bolt cage while being pulled off of a roll of steel brought in by truck or other equipment to the construction site. Alternatively, individual loops may be installed with the the understanding that installation will generally take longer than with a continuous strand wound in spiral loops as has been described. The looped steel is preferably wire-tied or otherwise secured to the anchor bolts at appropriate intervals as the steel is wound around the tower anchor bolt cage to ensure that the loops remain in place and at the desired vertical spacing during concrete pour.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. Therefore, it is not desired to limit the invention to the specific examples disclosed or the exact construction and operation shown and described. Father, all suitable modifications and equivalents may be resorted to, falling within the scope of the invention.

What is claimed is:

1. A method of installing a laterally reinforced concrete pier foundation comprising:

excavating a hole;

assembling a tower anchor bolt cage having an outer perimeter including a plurality of sleeved anchor bolts in an annular arrangement, said sleeved anchor bolts each have a lower end and an upper end, and secured at their lower ends, said lower ends being adjacent a bottom of the laterally reinforced concrete pier foundation with the upper ends of the sleeved anchor bolts extending above a top of the laterally reinforced concrete pier foundation when the tower anchor bolt cage is placed within the hole; and wrapping the outer perimeter of the tower anchor bolt cage with, and individually securing the sleeved anchor bolts to, a spiral loop steel addition having opposing ends over at least a lower end thereof to produce a wrapped tower anchor bolt cage and provide lateral shear reinforcement to the laterally reinforced concrete pier foundation;

positioning the wrapped tower anchor bolt cage within the hole; and securing the wrapped tower anchor bolt cage with concrete after said wrapped tower anchor bolt cage is positioned within the hole with the lower ends of the sleeved anchor bolts at the bottom of the laterally reinforced concrete pier foundation, wherein the opposing ends are embedded in the concrete;

wherein the step of excavating the hole includes digging an annular trench with undisturbed native soil forming a center area encircled by said trench, the wrapped tower anchor bolt cage being lowered into said trench and said step of securing including filling the trench with cementitious material.

* * * * *